United States Patent [19]

Eschen, Jr.

[11] 4,004,857

[45] Jan. 25, 1977

[54] MOVEABLE BARRIER APPARATUS FOR ROADWAY

[76] Inventor: Robert M. Eschen, Jr., 440 Grand Ave., Oakland, Calif. 94610

[22] Filed: Sept. 19, 1975

[21] Appl. No.: 614,916

[52] U.S. Cl. ..... 404/6; 404/9; 256/13.1

[51] Int. Cl.[2] ..... E01F 13/00

[58] Field of Search ..... 404/6, 9, 12, 13, 1; 256/13.1, 64

[56] References Cited

UNITED STATES PATENTS

| | | | |
|---|---|---|---|
| 2,143,433 | 1/1939 | Curtis | 404/1 |
| 2,260,051 | 10/1941 | Pardee | 404/12 |
| 2,287,685 | 6/1942 | Jelinek | 404/12 |
| 3,245,327 | 4/1966 | Wasley | 404/12 |
| 3,369,634 | 2/1968 | Mazelsky | 256/13.1 X |
| 3,391,620 | 7/1968 | Mahoney | 404/6 |
| 3,690,619 | 9/1972 | Kendall | 256/13.1 |

*Primary Examiner*—Nile C. Byers, Jr.
*Attorney, Agent, or Firm*—Flehr, Hohbach, Test, Albritton & Herbert

[57] ABSTRACT

Moveable barrier apparatus is disclosed for use in controlling traffic along parallel lanes of a roadway. The apparatus includes elongate channels which are embedded in the roadway transversely of the lanes at spaced-apart positions. Carrier cars are mounted by roller bearings for movement lengthwise within each channel, and posts which are mounted on the cars extend upwardly above the roadway through slots formed along the channels. An elongate upstanding barrier is mounted on the posts to form a divider between adjacent lanes of the roadway. Actuators are mounted in each of the channels for moving the cars and posts lengthwise of the channels for selectively changing the transverse position of the barrier. In one embodiment the actuator comprises a single hydraulic ram, and in another embodiment the actuator comprises a pair of telescoping hydraulic rams positioned on opposite sides of the car within the channel. A lane transition zone is provided in which the actuators are operated through differential strokes so that the lane division defined by the barrier follows a curved or slanted path. In the transition zone sliding joints are provided to accommodate displacement of the ends of the barrier sections relative to the posts. The control means for conjointly operating the actuators includes a parallel fluid circuit. Releasable connectors are provided in the circuit to facilitate coupling with a mobile source of fluid pressure.

6 Claims, 7 Drawing Figures

MOVEABLE BARRIER APPARATUS FOR ROADWAY

BACKGROUND OF THE INVENTION

This invention relates in general to highway traffic control systems, and in particular relates to barriers which form traffic lane dividers.

Traffic control systems have previously been provided in which lane dividers or barriers have been mounted for transverse movement to vary the number of lanes in the different traffic streams. One system which has been proposed is that disclosed in the U.S. Pat. to Curtis No. 2,143,433 in which a barrier is mounted for transverse movement over an elevated highway by means of a single motor driving a common shaft which in turn drives cables connected with carriages upon which the barrier is mounted. Another prior art system is that of the Mahoney U.S. Pat. No. 3,391,620 in which the barrier is moved transversely of the roadway by means of a drive motor which is carried by the barrier and engages a flexible belt, the ends of which are trained along and affixed to opposite ends of a transverse groove formed in the roadway.

Moveable barrier systems of the type described have a number of limitations and have not been adopted in practice. In many cases it is desirable to divide the lanes of traffic in a manner which provides a transition zone where the divider barrier follows a curved or slanted path so that the flow of traffic can either spread out or neck down, such as at a toll plaza. The moveable barrier systems which have heretofore been proposed have not been adaptable to providing a system in which the barrier can change in such a transition zone.

It would be desirable to provide a moveable barrier system which is more simple and inexpensive in design and construction as compared to prior barrier systems, and furthermore which is easier to operate and maintain. Such a barrier system must also be capable of absorbing severe shock forces, such as by collision from a vehicle, and the prior art barrier systems are limited in their shock force absorbing capabilities. It would therefore be desirable to provide a moveable barrier system which is not only simple in its mode of operation but which can absorb high shock forces without damage.

OBJECTS AND SUMMARY OF THE INVENTION

It is a general object of the invention to provide a new and improved moveable barrier apparatus for controlling traffic on a roadway.

Another object is to provide moveable barrier apparatus which is relatively simple in design and construction and which can be readily mounted in existing roadways without major modification thereto.

Another object is to provide moveable barrier apparatus of the type described in which the barrier is moved transversely of the roadway by means of hydraulic rams which serve to resist and transmit shock forces directly to the roadway.

Another object is to provide moveable barrier apparatus of the type described employing extensible hydraulic rams for moving the barrier by means of a fluid circuit connecting the rams in parallel with a source of fluid pressure for conjoint actuation and in which the source can be mobile to couple with different sections of the barrier system.

Another object is to provide moveable barrier apparatus of the type described in which a portion of the barrier comprises a lane transition zone whereby the barrier sections in this zone are moved through differential distances so that the barrier follows a curved or slanted path along the traffic lanes.

Another object is to provide moveable barrier apparaus of the type described in which the barrier is mounted on posts which are carried on cars mounted for movement along elongate channels embedded transversely within the roadway. Linear actuators are mounted within the channels for moving the cars and thereby the barrier to selected positions.

The invention in summary comprises a moveable barrier apparatus having a plurality of elongate channels transversely embedded in the roadway at spaced-apart positions. Carrier cars are mounted for movement longitudinally within each channel, and the cars carry vertical posts which extend through upwardly-open slots above the roadway. An elongate barrier is mounted on the posts to form a lane divider. The barrier is moved transversely by means of actuators mounted within the channels. In one embodiment the actuators comprise hydraulic rams mounted at their opposite ends between the cars and channels, and in another embodiment the actuators comprise pairs of telescoping rams mounted on opposite sides of the cars within the channels. Circuit means is provided for connecting the rams in parallel with a source of fluid under pressure for conjoint extension or retraction. In a lane transition zone barrier sections are provided between adjacent posts with the ends of the barrier sections being mounted on the posts through sliding joints. The control means differentially operates the actuators connected to move the barrier sections in the transition zone so that the barrier assumes a curved or slanted path. Releasable connections are provided in the circuit for coupling with a mobile source of fluid pressure.

The foregoing and additional objects and features of the invention will become apparent from the following description in which the preferred embodiments have been set forth in conjunction with the accompanying drawings.

DESCRIPTION OF THE PREFERRED EMBODIMENTS

Figure 1:
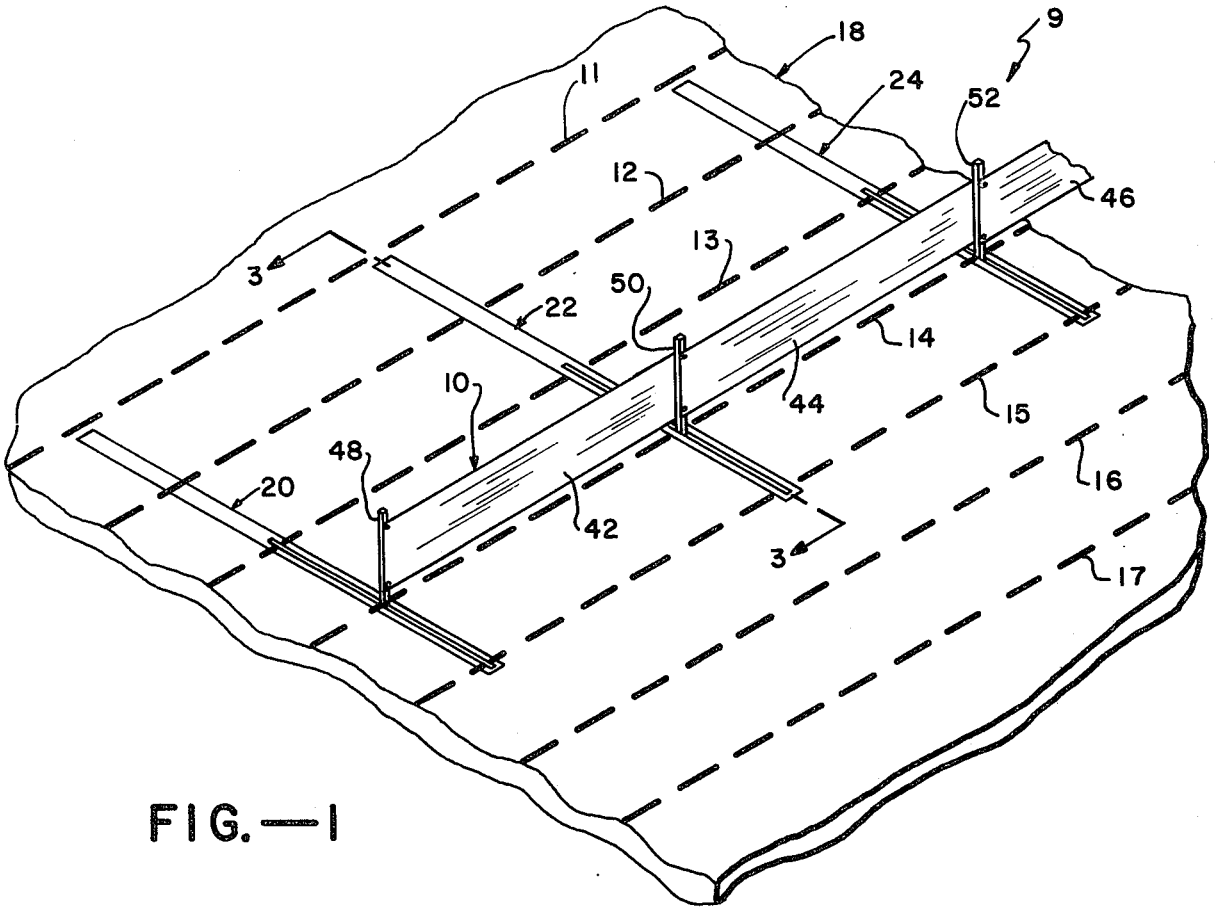
FIG. 1 is a perspective view of a moveable highway barrier system according to the invention.

In the drawings FIG. 1 illustrates generally at 9 moveable barrier apparatus of the invention incorporating a barrier 10 controlling the flow of traffic along a plurality of lanes defined by divider stripes 11-17 marked on a roadway 18. The illustrated roadway is shown as divided into eight lanes with barrier apparatus 9 being adapted to selectively divide the traffic in three modes, i.e., in one mode with the two traffic streams running in four lanes on opposite sides of the barrier as shown in FIG. 1, in another mode with five lanes on one side of the barrier and three lanes on the opposite side, and in a third mode with three lanes on the first mentioned side and five lanes on the opposite side. It is understood that the invention can be adapted for any desired number of traffic lanes and with any number of lane division modes.

Figure 3:
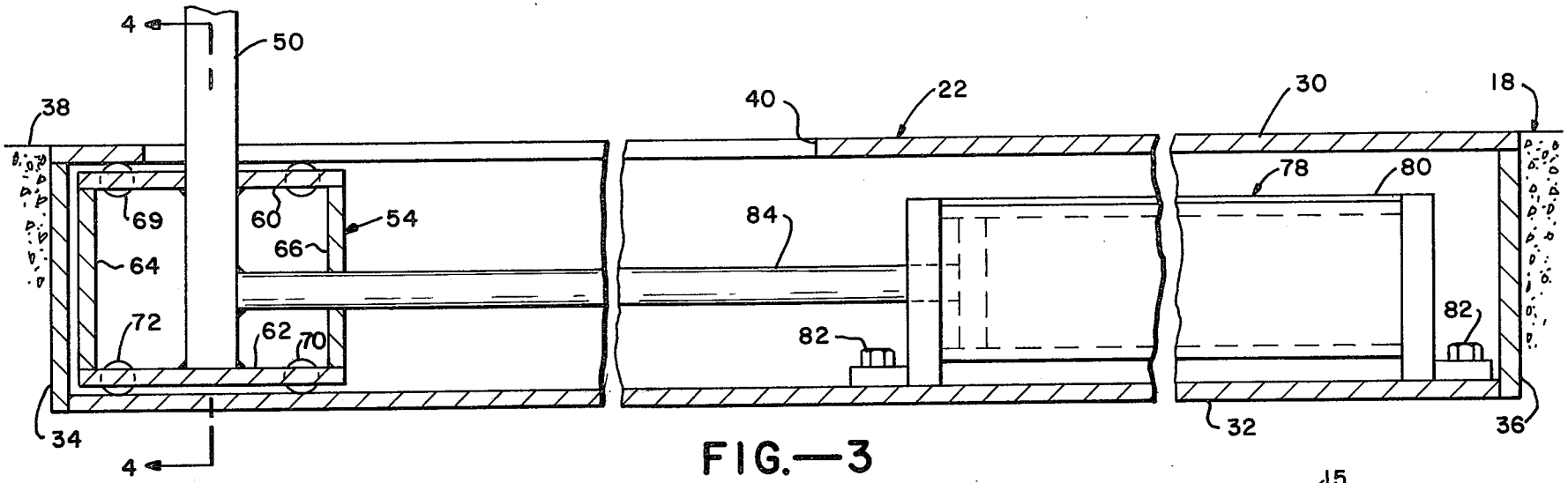
FIG. 3 is a cross-sectional view taken along the line 3—3 of FIG. 1.
Figure 4:
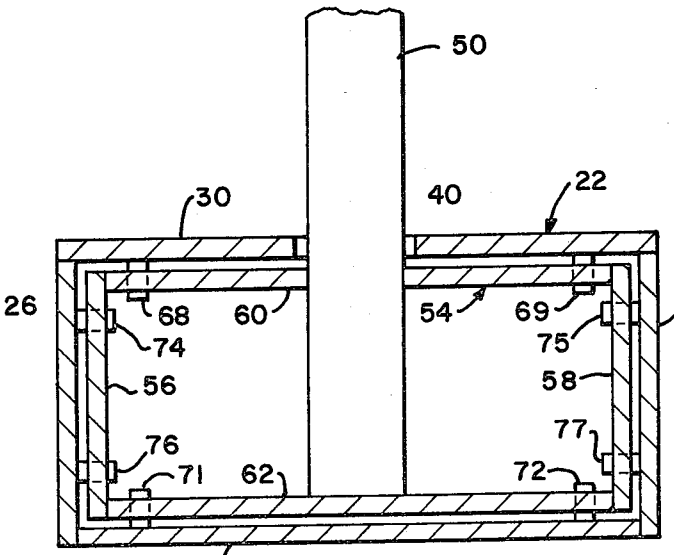
FIG. 4 is a cross-sectional view taken along the line 4—4 of FIG. 3.

Barrier apparatus 10 includes a plurality of transversely extending channels 20, 22, and 24 which are embedded in roadway 18 flush with the upper surface at spaced-apart positions along the desired length of the barrier system. The channel 22 of FIGS. 3 and 4 is typical and is of elongate box-sectional configuration formed of a pair of sidewalls 26, 28, top and bottom walls 30, 32, and end plates 34, 36 fabricated from a suitable material such as steel. The side and bottom walls and end plates are joined together at their side margins by means such as welding to form a rigid structure. The top wall 30 is removably mounted above the channel by suitable fasteners to facilitate access for maintenance or replacement of the components within the channel. The side and bottom walls and end plates of the channel are surrounded by the roadway material 38, which can be macadam, concrete or the like. An elongate slot 40 is formed in top wall 30 along the length through which the barrier is to be moved laterally of the roadway.

Barrier 10 comprises a plurality of elongate, upstanding sections or panels 42,44,46 mounted lengthwise of the roadway on upstanding posts 48,50,52. The barrier panels are formed of a suitable high strength, impact-resistant material such as a flat metal ribbon, reinforced conveyor belting or the like. Each barrier post is mounted onto a respective carrier car 54 in the channels with the posts extending upwardly through the slots. A suitable yieldable slot cover such as intermeshing brush elements, not shown, can be mounted along the sides of the slots to seal the channel from entry of foreign material but yet permit the post to freely move back and forth along the length of the slot.

The cars 54 in each channel are box-shaped and are formed of sidewalls 56, 58, top and bottom walls 60, 62 and end plates 64, 66. The post 50 extends downwardly through an opening in top wall 60 and abuts bottom wall 62, with the post being rigidly secured to these members by means such as welding. The car 54 is mounted for back and forth movement longitudinally of the channel beneath the slot by bearing means comprising a plurality of roller bearings 68. Four bearings 68–72 are journaled in slots provided in each of the top and bottom walls, and similarly four bearings 74–77 are journaled in slots provided in each of the sidewalls, as best illustrated in FIG. 4. The bearings rotatably contact respective inner sides of the top, bottom and sidewalls of the channel both to support the car for movement and also to resist bending moment forces imposed on the car when shock forces impact upon the barrier and post.

Figure 5:
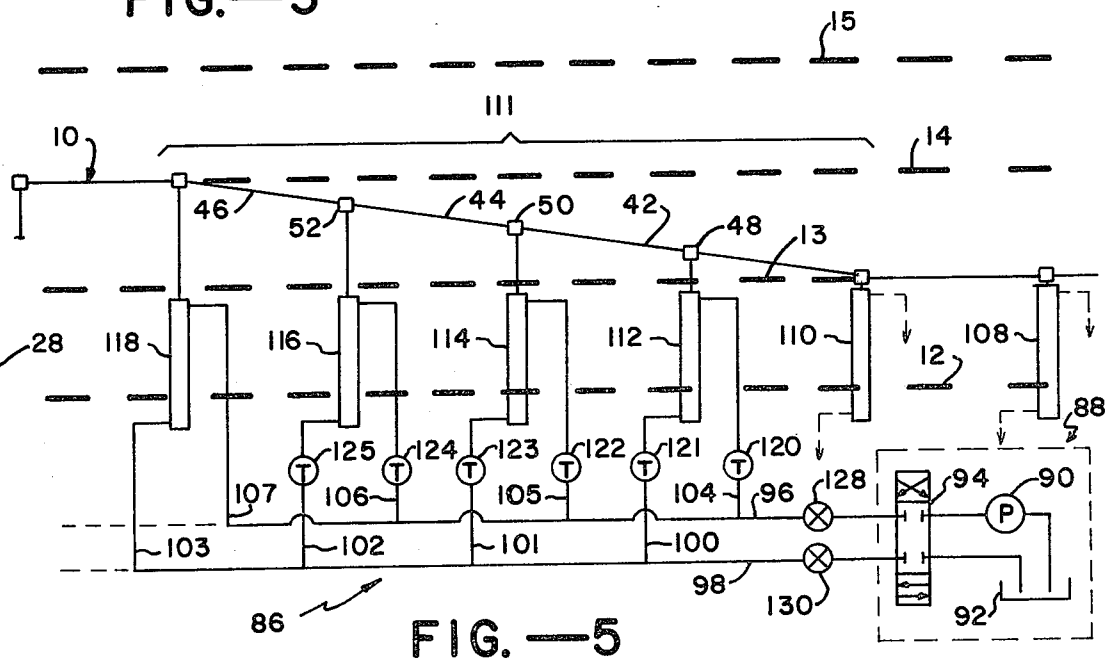
FIG. 5 is a schematic diagram of the hydraulic control circuit for the embodiment of FIGS. 1–4.

Actuator means is provided for moving the cars and thereby the barriers back and forth along the length of the slots. In the embodiment of FIG. 1 the actuator means comprises an extensible hydraulic ram 114 having its cylinder 80 fixedly attached by suitable means such as the heavy duty fasteners 82 onto an end of the channel. Piston rod 84 of this ram is mounted at its distal end by means such as welding to the car 54 and post 50 so that extension and retraction of the rod carries the car and barrier respectively to the left and right as viewed in FIG. 3. The control means 86 illustrated schematically in FIG. 5 is provided for operating the rams when it is desired to change the barrier position. The control means is adapted to hydraulically lock the rams and hold the barriers fixed in the desired lane division position. When the rams are thus hydraulically locked and forces impacting upon the barrier such as when struck by a vehicle are serially carried through and resisted by the car, piston rod, cylinder, channel and roadway.

Control means 86 includes a parallel fluid circuit which operates an adjacent series of the actuators or rams conjointly so as to move the associated barrier panels in unison to effect a change in lane division. The number of rams thus connected in each circuit would vary depending on the length of the barrier which is to be moved at one time. The control circuit includes a source 88 of hydraulic fluid under pressure comprising a pump 90 receiving supply fluid from a reservoir 92, together with a three-way valve 94 actuated either manually or by a suitable remote control device. The valve 94 is operable in one mode to direct pressurized fluid through a manifold conduit 96, with return fluid being directed through a manifold conduit 98 back to the reservoir. In another mode the valve reverses the flow by directing pressurized fluid through conduit 98 with return fluid being directed through conduit 96 back to the reservoir. In the off mode of the valve the fluid source is isolated from the conduits so that the rams are hydraulically locked.

The parallel circuit of control means 86 includes branch conduits 100-103 connected with the head ends of the cylinder together with branch conduits 104-107 connected with the rod ends so that when pressure is directed into either the head or rod ends the associated piston rods will simultaneously extend and retract, respectively.

The barrier panels and posts which are operated by the series of rams connected with full-line pressure from the source 88, e.g. rams 108, 110, and 118, move at the same rate during lane change. A transition zone 112 is provided at which a variable rate of ram movement is established so that the rams 112-116 lying in the zone are operated at differential rates. Thus the posts supporting the barrier panels in the transition zone are moved through different distances with the result that the barrier assumes a curved or slanted path in this zone. The transition zone is used to gradually change the number of lanes in a stream of traffic, such as when leading up to or going from a toll plaza.

Means for differentially operating the rams in the transition zone is provided and comprises a series of suitable throttle valves 120–125 connected in the branch conduits leading to the head and rod ends of the rams 112–116. These throttle valves are adapted to be set so that fluid flow and therefore piston movement is restricted during either extension or retraction. The degree of throttling of the three rams is also differentially adjustable to obtain the desired curve in the barrier. Thus, in the example shown in FIG. 5 the throttle valves 122 and 124 for rams 114 and 116 are set to throttle flow to a progressively greater extent than the setting for valve 120 of ram 112. The ram 118 and the remaining rams to the left in the series are unthrottled so that they can move their associated posts and barrier panels the full lane change distance. During this lane change operation actuator 108 is not energized so that its associated post and barrier panel remain in place. The throttle valves could also be set at fully open position where it is desired to move all barrier panels in the transition zone at the same rate as the remaining panels.

Fluid pressure source 88 can either be fixed in position along the roadway, such as at a stationary pumping station, or the pump 90, reservoir 92 and control valve 94 can be mounted on a mobile vehicle. In this latter case a pair of plug-in connectors 128, 130 are provided in manifold conduits 96 and 98 for releasably coupling the fluid source with a series of actuators along a section of the roadway. In the example of FIG. 5 the adjacent actuators in transition zone 112 together with an additional number of actuators in series to the left of this zone are conjointly actuated when the mobile source is plugged into the connectors. The circuits of actuators along other sections of the roadway are similarly provided with plug-in connectors so that the mobile source can travel these other sections for moving the barriers.

Figure 2:
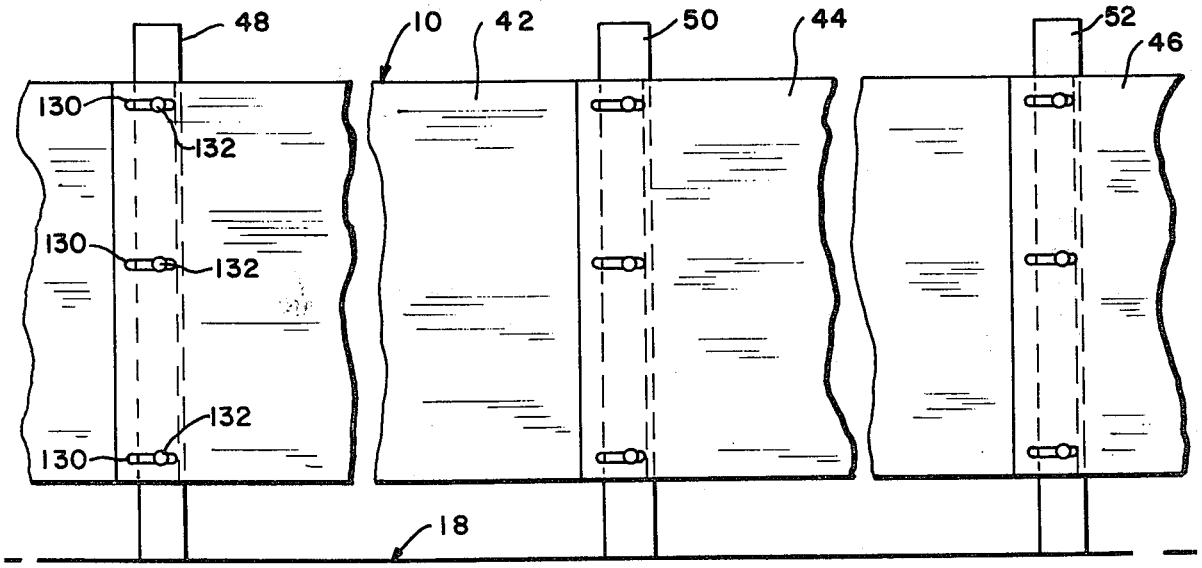
FIG. 2 is a fragmentary elevational view showing a portion of the barrier structure in a lane transition zone.

In transition zone 112 the barrier panels are mounted on the associated posts by yielding or sliding joint means comprising the pin and slot connection arrangement illustrated in FIG. 2. The right-hand end, as viewed in FIG. 2, of barrier panel 42 is fixedly mounted on post 50 while its opposite end is formed with three vertically spaced elongate slots 130. Horizontally extending pins 132 project through the slots and are mounted on the post 48. During differential extension and retraction of the actuators in the transition zone the pin and slot connections will acccommodate the resulting change in linear distance between the posts. A similar pin and slot connection is provided at sections of the roadway along a curve where the curved portion of the barrier changes in length as a function of its radius.

Figure 6:
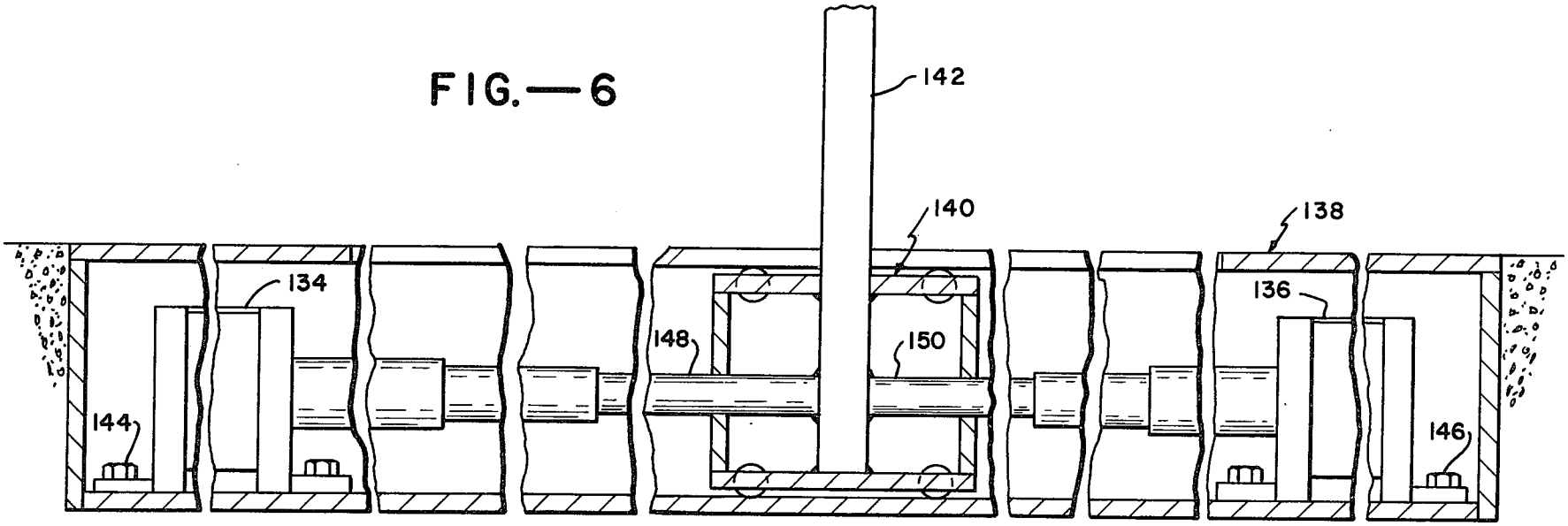
FIG. 6 is a fragmentary axial section view of a portion of another embodiment of the invention employing telescoping rams.
Figure 7:
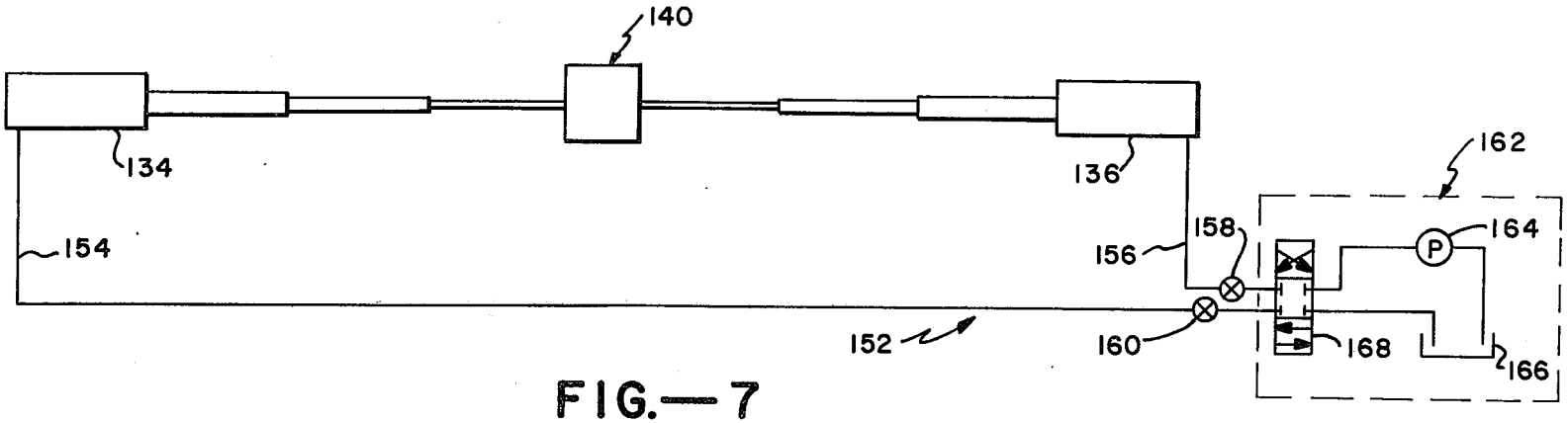
FIG. 7 is a schematic diagram of the control system employed for the embodiment of FIG. 6.

FIGS. 6 and 7 illustrate another embodiment of the invention in which a pair of extensible telescoping hydraulic actuators 134 and 136 are provided to move the barriers. In this embodiment the barrier apparatus includes a plurality of channels 138 embedded in the roadway transversely of the lanes, and a carrier car 140 is mounted for movement within the channel by roller bearings in a manner similar to that described for the foregoing embodiment. An upstanding post 142 is fixedly mounted on the car and extends upwardly through a slot formed along the upper wall of the channel. The ends of the barrier panels, not shown, are mounted on the posts in a manner similar to that previously described.

The telescoping actuators 134, 136 are mounted within channel 138 on opposite sides of the car. The head ends of the actuators are fixedly attached by suitable fasteners 144, 146 to the respective ends of the channel bottom wall, and the rod ends 148, 150 extend through the end plates of the car and abut post 142 to which they are secured by means such as welding. The telescoping actuators provide a relatively long stroke for their retracted length and can be used where the barrier is to be moved a relatively long distance across the roadway, such as between two or more traffic lanes.

Control circuit means 152 illustrated schematically in FIG. 7 is provided for operating the telescoping actuators. Conduit 154 and 156 are connected with respective head and rod ends of each actuator, and a plurality of the actuator pairs at adjacent positions along the roadway are connected in a parallel cirucit, not shown, with plug-in connectors 158, 160. A fluid pressure source 162 is provided and includes a pump 164, reservoir 166 and three-way valve 168 of the type described in connection with the embodiment of FIG. 5. The source 162 can either be provided at a stationary location along the roadway, or it can be mounted in a mobile vehicle for transport to different sections of the roadway where it is plugged into the connectors 158, 160 of the circuits for each series of actuators.

Valve 168 is operated by suitable manual or remote control means in one mode to direct fluid under pressure through conduit 156 to extend actuator 136 while return fluid is being directed through conduit 154 back to the reservoir, in another mode to reverse the flow by directing pressurized fluid into conduit 154 to extend actuator 134 while actuator 136 is retracted, and in another mode to isolate the pump from the conduits so that the actuators are hydraulically locked.

The use and operation of the embodiment of FIGS. 1–5 is as follows. It will be assumed that the actuators along the roadway are initially positioned so that the barrier panels extend in a path along the divider stripe 13 of FIG. 5. In this case all of the barrier panels initially follow a straight path. When it is desired to change the flow of traffic with barrier 10 following the curved path depicted in solid line in FIG. 5, the pressure source 88 is plugged into releasable connectors 128, 130. Valve 94 is operated to its reverse mode and pump 90 is energized so that fluid under pressure is directed into manifold conduit 98 and the head ends of the series of actuators. Fluid flow into the actuators 112-116 is throttled by the valves 121, 123 and 125 so that the rate of extension is low. The valves 123 and 125 throttle to a progressively lesser extent than the valve 121 so that the actuators 114 and 116 extend at a faster rate than the actuator 112. The actuator 118 as well as the remaining actuators extending to the left in the series and which are connected in the parallel circuit are unthrottled and thereby extend at their full rate. When the barrier panels connected with the unthrottled actuators are observed to reach the position of divider stripe 14 the operator shifts valve 94 to its center mode to disconnect the pump from the circuit. The differential movement of the actuators thereby causes the barrier panels in the transition zone to assume the illustrated angled path. During barrier movement the change in distance between the posts connected with the actuators in the transition zone is accommodated for by the slippage in the pin and slot connections on these posts. When it is desired to return the barriers to their original position along the lane, valve 94 is actuated so that pressurized fluid is directed through manifold conduit 96 and into the rod ends of the actuators which are thereby retracted. The flow through the conduits in the transition zone is throttled by the valves 120, 122 and 124 so that they differentially retract. The valve is returned to its center position to hydraulically lock the actuators when the barrier panels reach divider stripe 13.

The operation of the embodiment of FIG. 6 and 7 is similar to that descirbed for the first embodiment. When it is desired to move the car 140 and post 142 to the left as illustrated in FIG. 7 valve 168 is operated to direct fluid into conduit 156 and extend actuator 136.

When the barrier has reached the desired position the valve is actuated to its center mode at which both actuators are hydraulically locked. When it is desired to move the car in the opposite direction the valve is actuated to its reverse mode at which fluid is directed into conduit 154 to extend actuator 134.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed:

1. Moveable barrier apparatus for dividing parallel lanes of a roadway, comprising the combination of a plurality of spaced-apart elongate channels embedded in the roadway and extending transversely of the lanes, a car mounted for longitudinal movement within each channel, an elongate upstanding barrier mounted above the roadway for movement with the cars, the barrier extending in a direction lengthwise of the lanes, actuator means within each channel, the actuator means being interconnectted between one end of the respective channel and the car which is associated therewith, said actuator means associated with each channel comprising a pair of extensible hydraulic rams, each ram having a head end and a rod end, with the rams being positioned on opposite sides of the associated car and horizontally oriented at substantially right angles with the barrier, means for connecting one end of each of the rams to opposite ends of the respective channels and for connecting an opposite of each of the rams to the associated cars, and control means for operating the actuator means to conjointly move the cars to selected positions within the channels whereby the barrier is carried to a selected transverse position which divides the roadway into parallel traffic lanes, said control means including means for hydraulically locking the rams when the barrier is fixedly positioned whereby shock forces impacting upon either side of the barrier are carried through and resisted by the hydraulic fluid locked within the rams and thereafter by the channels and roadway.

2. Moveable barrier apparatus as in claim 1 which includes means for yieldably connecting a first portion of the barrier in a lane transition zone to a first series of the cars, and the actuator means moves the series of cars through predetermined differential distances whereby said first barrier portion is caused to assume a curved or slanted path relative to the remaining portion of the barrier.

3. Moveable barrier apparatus as in claim 2 which includes circuit means for directing fluid under pressure in parallel to the ram means, and means for throttling fluid flow in the circuit means whereby the strokes of the hydraulic ram means are moved through said differential distances.

4. Moveable barrier apparatus as in claim 1 in which the control means comprises circuit means for directing fluid under pressure in parallel flow to a series of adjacent rams for conjoint extension and retraction thereof, the circuit means including releasable connector means adapted for connection with a moveable source of fluid under pressure.

5. Moveable barrier apparatus for dividing parallel lanes of a roadway, comprising the combination of a plurality of spaced-apart elongate channels embedded in the roadway and extending transversely of the lanes, a car mounted for longitudinal movement within each channel, an elongate upstanding barrier extending in a direction lengthwise of the lanes, means forming an elongate slot opening upwardly through each channel, a plurality of upstanding posts, each post being mounted on a respective car and extending upwardly through the slot in the associated channel, a portion of the barrier comprising a lane transition zone formed of a plurality of barrier panels each of which is positioned between a pair of adjacent posts, actuator means within each channel, the actuator means being interconnected between one end of the respective channel and the car which is associated therewith, control means for operatinng the actuator means to conjointly move the cars to selected positions within the channels whereby the barriers are carried to a selected transverse position which divides the roadway into parallel traffic lanes, and yieldably joint means for interconnecting at least one end of each barrier panel to its associated post whereby differential transverse movement between pairs of adjacent posts in the transition zone is compensated for by relative movement at each joint between the associated barrier panel and post.

6. Moveable barrier apparatus as in claim 5 in which the yieldable joint means comprises pin means mounted on and extending outwardly from the posts in the transition zone, together with means forming horizontal slots in said one end of each barrier panel with the horizontal slots being slidably mounted on the pins for accommodating displacement of the barrier panels relative to the posts during differential transverse movement of the posts in the transition zone.

* * * * *